US006862959B2

(12) United States Patent
Lin Wu

(10) Patent No.: US 6,862,959 B2
(45) Date of Patent: Mar. 8, 2005

(54) PAIR OF PLIERS HAVING IDENTIFICATION FEATURES

(76) Inventor: Li-Tu Lin Wu, No. 367, Sec. 1, Mei-Tsun Rd., Taichung (TW)

( * ) Notice: Subject to any disclaimer, the term of this patent is extended or adjusted under 35 U.S.C. 154(b) by 51 days.

(21) Appl. No.: 10/413,474

(22) Filed: Apr. 15, 2003

(65) Prior Publication Data

US 2004/0206216 A1 Oct. 21, 2004

(51) Int. Cl.[7] ..... B25B 7/00
(52) U.S. Cl. ..... 81/300; 81/DIG. 5
(58) Field of Search ..... 81/300, DIG. 5

(56) References Cited

U.S. PATENT DOCUMENTS 3,760,473 A * 9/1973 Studdard ..... 407/29.1
4,950,365 A * 8/1990 Evans ..... 205/198
5,062,173 A * 11/1991 Collins et al. ..... 7/118
6,009,779 A * 1/2000 Mastroni ..... 81/438
6,024,000 A * 2/2000 Goldmann, II ..... 81/427.5
6,257,098 B1 * 7/2001 Cirone ..... 81/119
6,270,134 B1 * 8/2001 Lin ..... 294/16
6,393,950 B1 * 5/2002 Crosser ..... 81/119
6,490,950 B2 * 12/2002 Ray et al. ..... 76/119
6,668,751 B1 * 12/2003 Henke ..... 116/200

* cited by examiner

*Primary Examiner*—David B. Thomas
(74) *Attorney, Agent, or Firm*—Dennison, Schultz, Dougherty & MacDonald

(57) ABSTRACT

A pair of pliers has a handle (11), a head (13), a rivet (15), at least one colored layer (17) and optionally, plastic sleeves on the handle (11). The at least one colored layer (17) is at least one color especially designed with unique features to make identification of the pliers easy and make the pliers have an attractive appearance.

3 Claims, 8 Drawing Sheets

PAIR OF PLIERS HAVING IDENTIFICATION FEATURES

BACKGROUND OF THE INVENTION

1. Field of the Invention

The present invention relates to pliers, and more particularly to pliers with a tool head that has colored surfaces formed on the tool head for identification.

2. Description of Related Art

With reference to FIG. 8, a conventional pair of pliers comprises a head (50), a handle (60) and plastic sleeves (62). The head (50) is composed of a pair of jaws. The handle (60) is composed of a pair of grips formed respectively with the jaws. The plastic sleeves (62) are mounted respectively on the grips of the handle (60). The head (50) of conventional pliers is usually made of metal and is either blacked or natural. Therefore, the head (50) of conventional pliers are either the original color of the metal or a blacked color. Consequently conventional pliers are unattractive, have only one color and do not have any features that can be used for identification. When many similar conventional pliers are mixed together, individual types or brands of conventional pliers are hard to distinguished from each other. Therefore, conventional pliers do not have either visual or the identification features to promote sales or make pliers of different brands uniquely identifiable.

The present invention has arisen to mitigate or obviate the disadvantages of the conventional pliers.

SUMMARY OF THE INVENTION

The main objective of the present invention is to provide an identification capability and attractive features to pliers.

Pliers in accordance with the present invention have heads with colored surfaces to enhance the attractiveness of the pliers and provide an identification feature.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
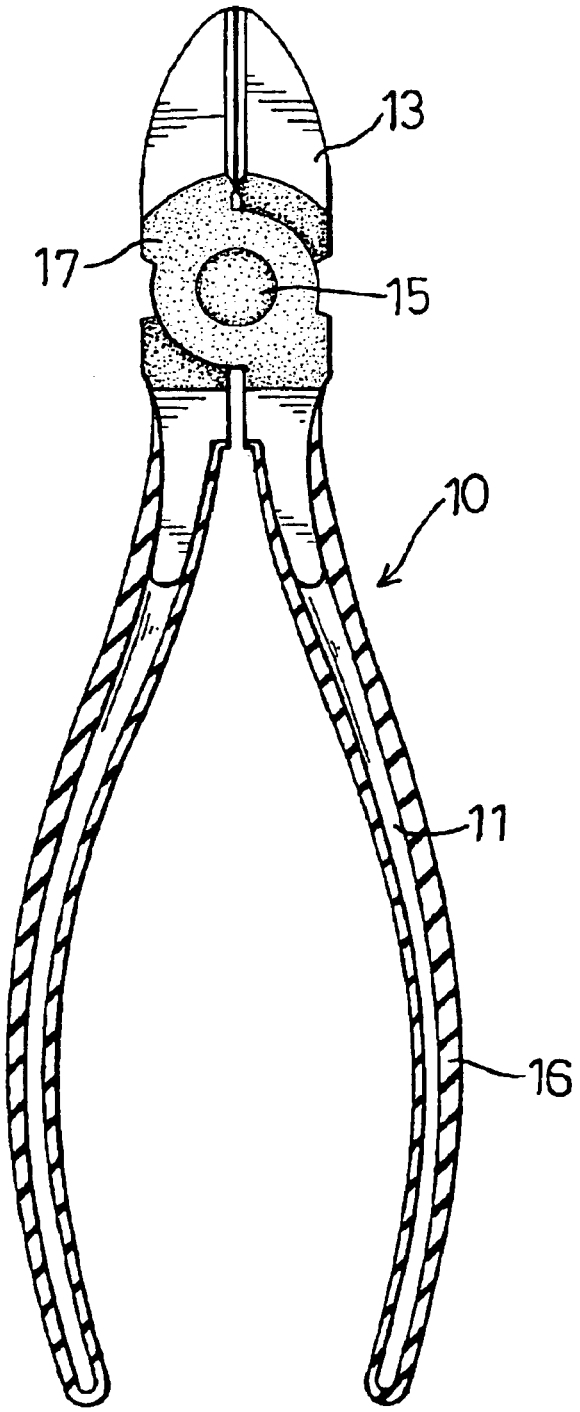
FIG. 1 is a side plane view in partial section of a first embodiment of pliers in accordance with the present invention.

With reference to FIG. 1, a first embodiment of pliers (10) in accordance with the present invention are made of metal and comprise of a handle (11), a head (13), a rivet (15), at least one colored layer (17) and optionally, plastic sleeves (16) on the handle (11).

The handle (11) is a pair of grips (not numbered), and the head (13) is a pair of jaws (not numbered). The head (13) has an exterior surface. The jaws are integrally formed with and extend from the grips respectively to form two complementary half bodies (not numbered) of the pliers. The half bodies are pivotally connected to each other by pivotally attaching the rivet (15) at a joint between the grips and the jaws. Optionally, a plastic sleeve (16) is applied to each grip of the handle (11) to aid in holding the pliers. In the first embodiment, a colored layer (17) is attached to the exterior surface of the head (13) at the joint around the rivet (15) on the pliers. The colored layer (17) is selectively formed on the pliers by coating, sandblasting, bonding, etc. and is at least one color to make the pliers vivid, attractive and uniquely identifiable.

Figure 2:
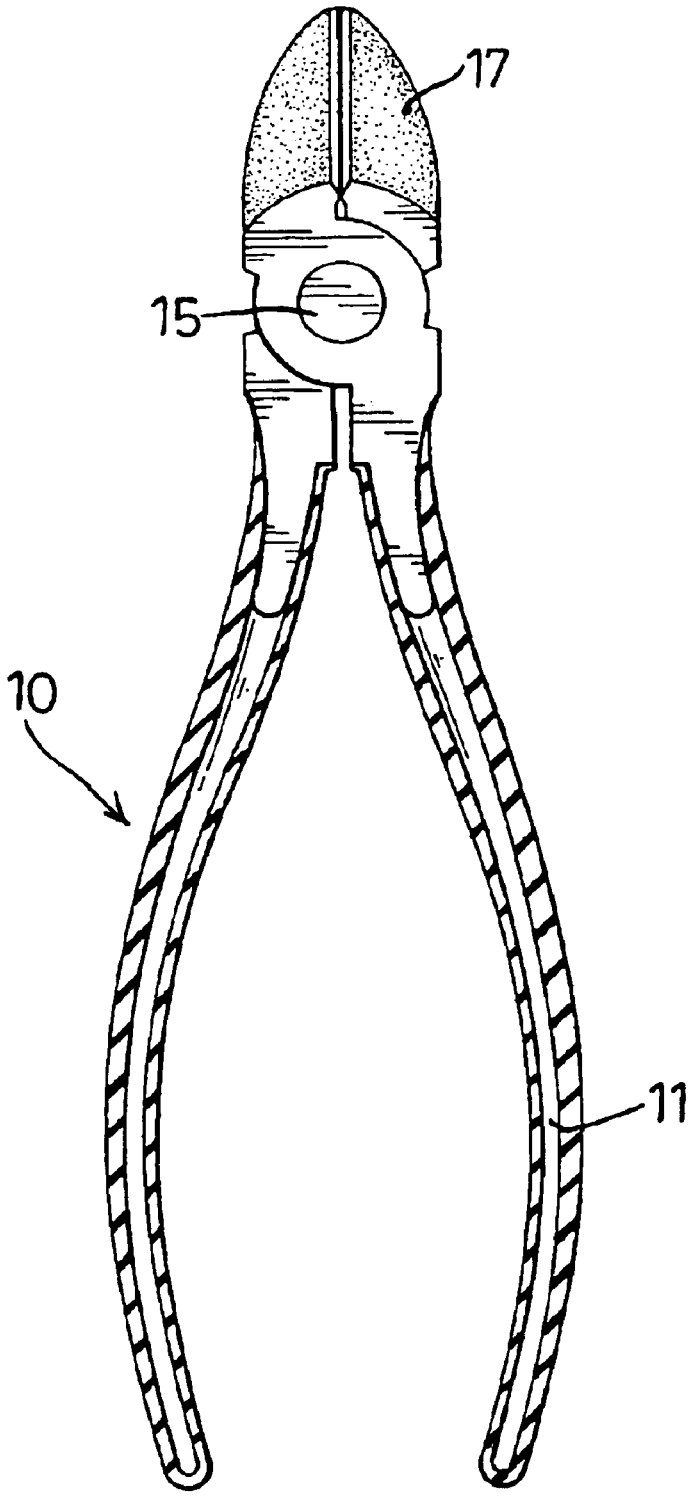
FIG. 2 is a side plane view in partial section of a second embodiment of pliers in accordance with the present invention complementary to the pliers in FIG. 1.

With further reference to FIG. 2, a second embodiment of pliers in accordance with the present invention has a colored layer (17) formed on the exterior surface of the head (13) in areas complementary to the first embodiment. The colored layer (17) is attached to the distal portions of the jaws of the head (13).

Figure 3:
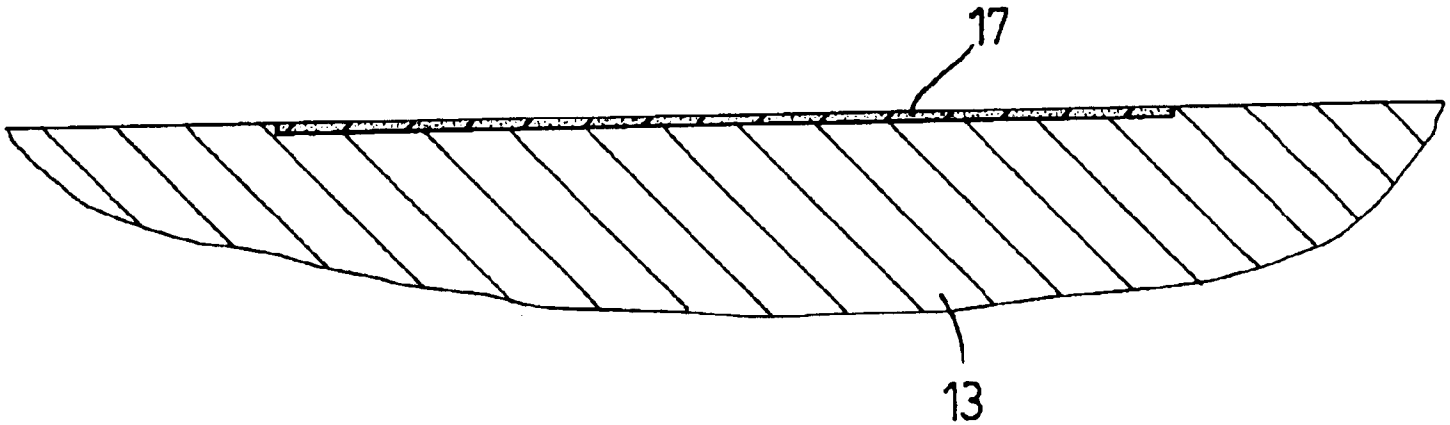
FIG. 3 is an enlarged cross-sectional side plane view of a part of a head of the pliers in FIGS. 1 and 2 with a colored layer applied to the head.

With reference to FIG. 3, the pliers are molded with excess metal in desired areas of the head (13), specifically the areas to which the colored layer (17) is to be attached. After pliers are molded, the pliers have smooth surfaces, and metal in the desired areas etched or machined to create rough surfaces to which the colored layers (17) are applied. The etched or machined areas are recessed so the colored layers (17) fill the areas and are flush with adjacent areas of the pliers after attaching the colored layers (17).

Figure 4:
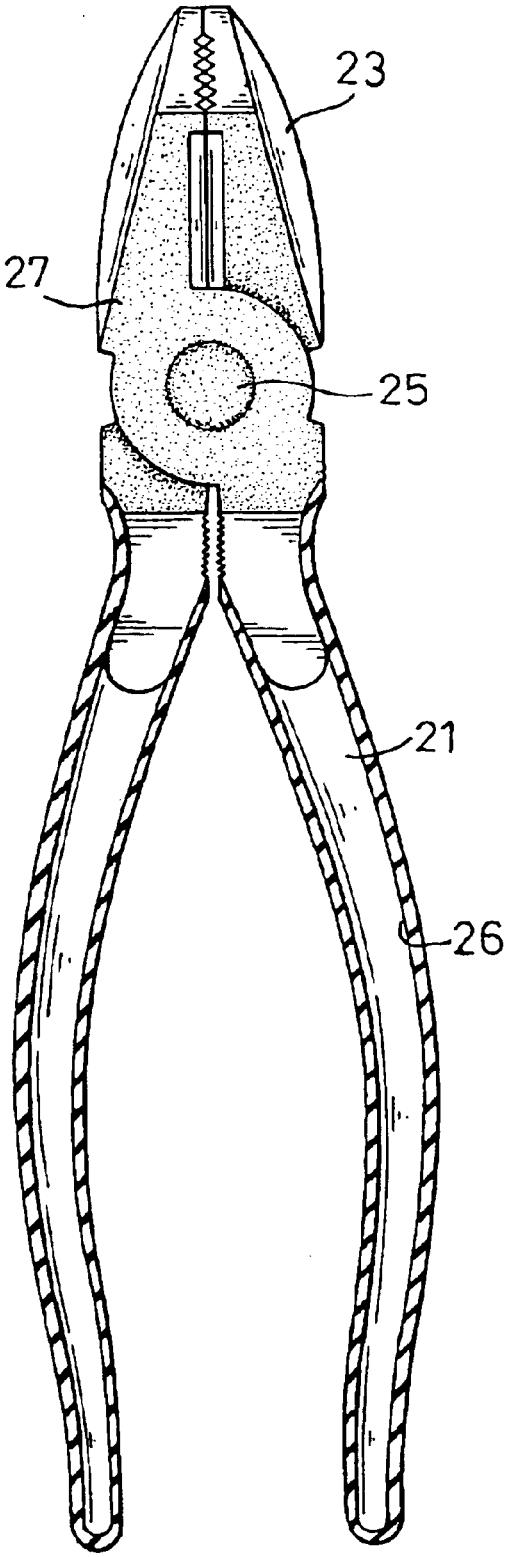
FIG. 4 is a side plane view in partial section of a third embodiment of pliers in accordance with the present invention.

With reference to FIG. 4, a third embodiment of pliers such as side-cutters (20) in accordance with the present invention are made of metal and is composed of a handle (21), a head (23), a rivet (25), at least one coloring layer (27) and optionally, plastic sleeves (26) on the handle (21).

The handle (21) is a pair of grips (not numbered), and the head (23) is a pair of jaws (not numbered). The head (21) has an exterior surface. The jaws respectively have a distal portion (not numbered), a middle portion (not numbered), teeth (not numbered) and a cutting edge (not numbered) and are integrally formed with and extend from the grips respectively to form two complementary half bodies (not numbered) of the pliers. The teeth are formed on the distal portions of the jaws to hold objects. The cutting edges are formed on the middle portions of the jaws adjacent to the teeth to cut objects. The half bodies are pivotally connected to each other by pivotally attaching the rivet (25) at a joint between the grips and jaws. Optionally, a plastic sleeve (26) is applied to each grip of the handle (21) to aid in holding the pliers. A colored layer (27) is attached to the exterior surface of the head (23) at the joint around the rivet (25) on the middle portion of the jaws of the pliers.

Figure 5:
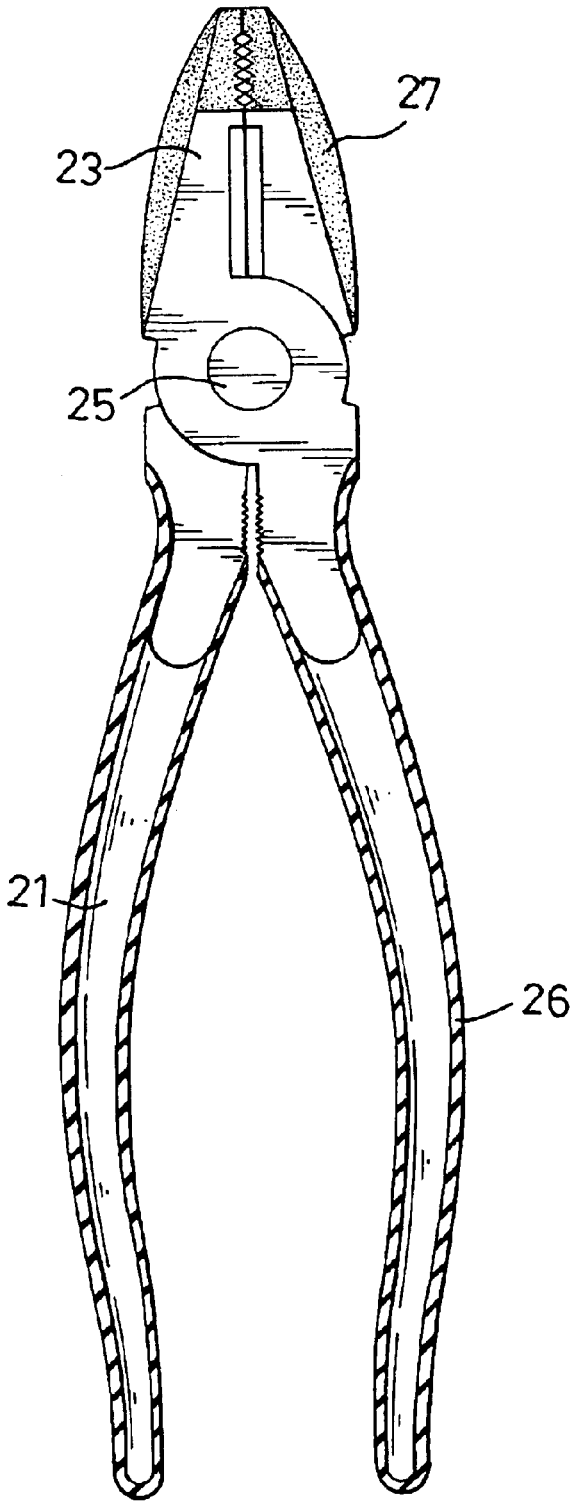
FIG. 5 is a side plane view in partial section of a fourth embodiment of pliers in accordance with the present invention complementary to the pliers in FIG. 4.

With further reference to FIG. 5, a fourth embodiment of pliers in accordance with the present invention has a colored layer (27) formed on the exterior surface of the head (23) in areas complementary to the third embodiment. The colored layer (27) is attached to the distal portions of the jaws of the head (23).

Figure 6:
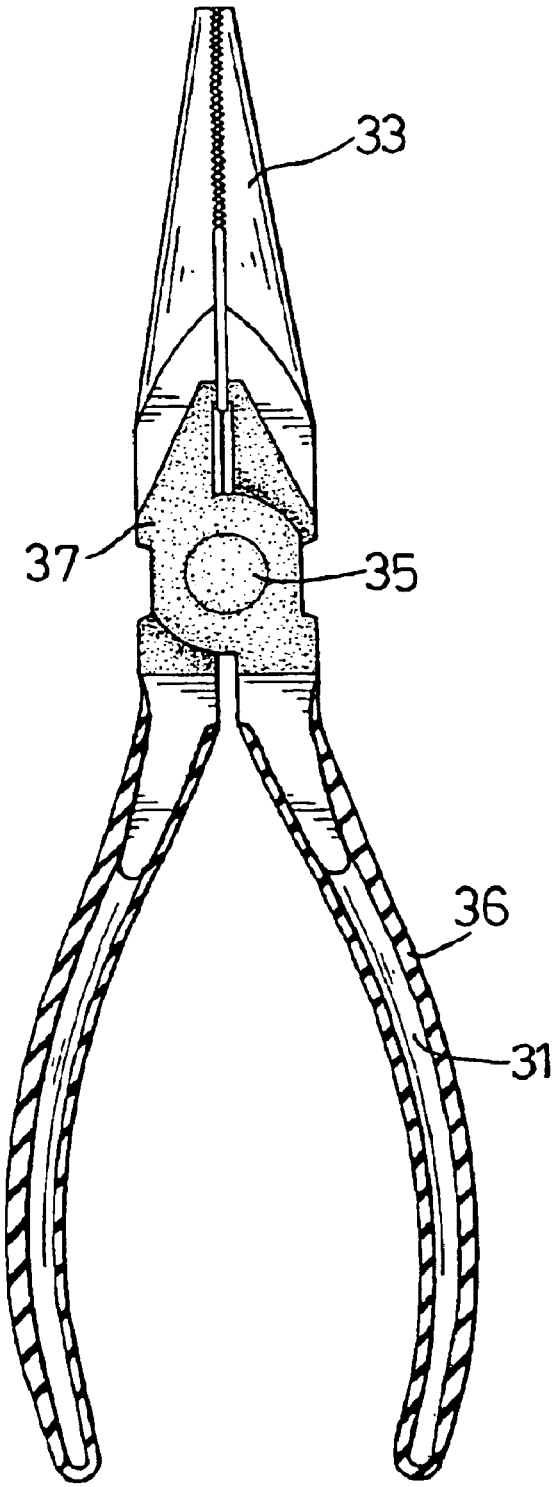
FIG. 6 is a side plane view in partial section of a fifth embodiment of pliers in accordance with the present invention.

With reference to FIG. 6, a fifth embodiment of pliers such as needle nose pliers (30) in accordance with the present invention are made of metal and is composed of a handle (31), a head (33), a rivet (35), at least one colored layer (37) and optionally, plastic sleeves (36) on the handle (31).

The handle (31) is composed of a pair of grips (not numbered), and the head (33) is composed of a pair of jaws (not numbered). The head (33) has an exterior surface. The jaws respectively have a distal portion (not numbered), a middle portion (not numbered), teeth (not numbered) and a cutting edge (not numbered) and are integrally formed with and extend from the grips respectively to form two complementary half bodies (not numbered) of the pliers. The teeth are formed on the distal portions of the jaws to hold objects. The cutting edges are formed on the middle portions of the jaws adjacent to the teeth to cut objects. The half bodies are pivotally connected to each other by pivotally attaching the rivet (35) at a joint between the grips and jaws. Optionally, a plastic sleeve (36) is applied to each grip of the handle (31) to aid in holding the pliers. A colored layer (37) is attached to the exterior surface of the head (33) at the joint around the rivet (35) on the middle portion of the jaws of the pliers.

Figure 7:
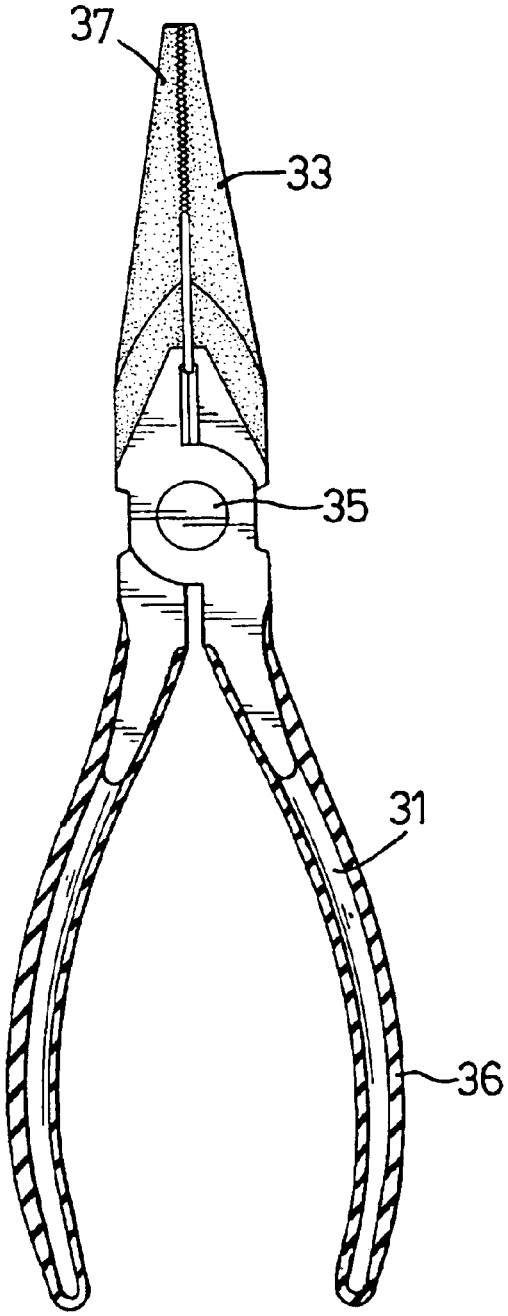
FIG. 7 is a side plane view in partial section of a sixth embodiment of the pliers in accordance with the present invention complementary to the pliers in FIG. 6.
Figure 8:
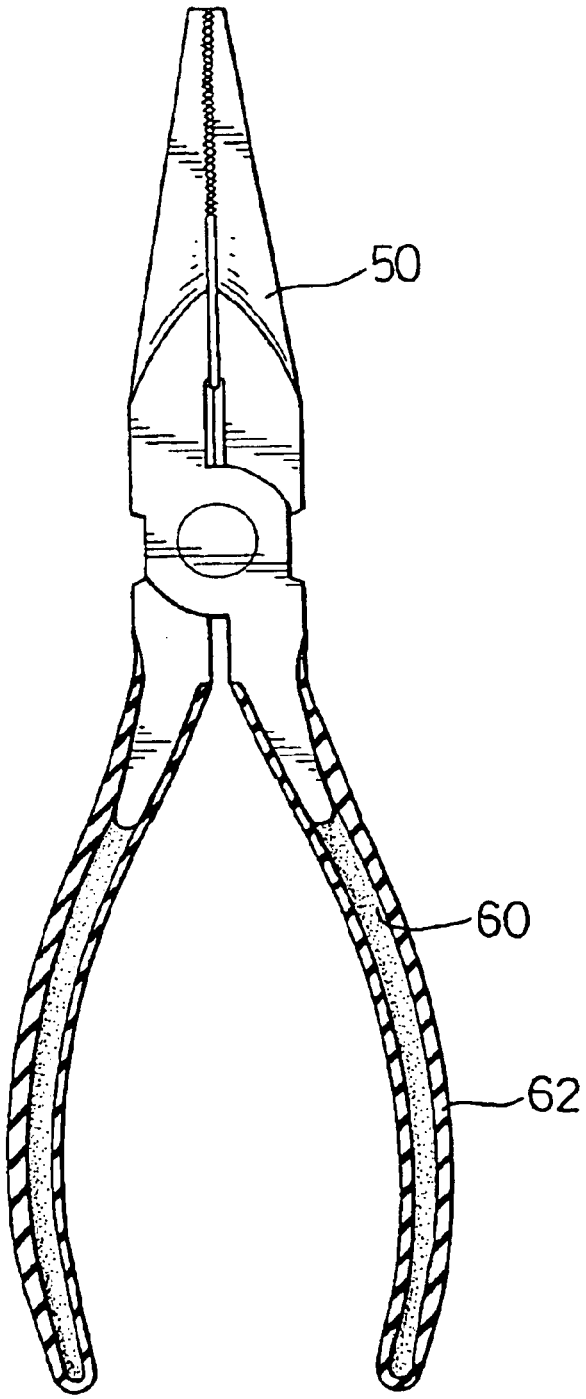
FIG.8 PRIOR ART
FIG. 8 is a side plane view in partial section of a pair of conventional pliers in accordance with the prior art.

With further reference to FIG. 7, a sixth embodiment of pliers in accordance with the present invention has a colored layer (37) formed on the exterior surface of the head (33) in areas complementary to the fifth embodiment. The colored layer (37) is attached to the distal portions of the jaws of the head (33).

Since the pliers in accordance with the present invention have different colored layers formed on the head, the pliers have a vivid feature to catch consumers' attention. Additionally, the colored layer of multiple colors can be designed in different patterns for different brands or kinds of pliers so the pliers can be easily identified Although the invention has been explained in relation to its preferred embodiment, many other possible modifications and variations can be made without departing from the spirit and scope of the invention as hereinafter claimed.

What is claimed is:

1. A pair of pliers made of metal and comprising:

a handle (11);

a head (13) having an exterior surface and attached to the handle;

a rivet (15) pivotally attaching the handle (11) and head (13);

at least one colored layer (17) attached on the head (13); and at least one rough recessed area formed on the exterior surface of the head (13) to attach each respective one of the at least one colored layer (17).

2. The pliers as claimed in claim 1, wherein the at least one colored layer (17) is attached around the rivet (25) at a joint between the handle (11) and the head (13).

3. The pliers as claimed in claim 1, wherein the head is composed of a pair of jaws with distal portions; and the at least one colored layer is attached to the distal portions of the jaws.

* * * * *